US010386146B2

(12) United States Patent
Spector et al.

(10) Patent No.: US 10,386,146 B2
(45) Date of Patent: Aug. 20, 2019

(54) HANDGUARD AND BARREL ASSEMBLY WITH SOUND SUPPRESSOR FOR A FIREARM

(71) Applicant: Radical Firearms, LLC, Stafford, TX (US)

(72) Inventors: David Morris Spector, Missouri City, TX (US); Philip Brent Middleton, Sugar Land, TX (US)

(73) Assignee: Radical Firearms, LLC, Stafford, TX (US)

( * ) Notice: Subject to any disclaimer, the term of this patent is extended or adjusted under 35 U.S.C. 154(b) by 89 days.

(21) Appl. No.: 15/332,697

(22) Filed: Oct. 24, 2016

(65) Prior Publication Data

US 2017/0299291 A1 Oct. 19, 2017

Related U.S. Application Data

(60) Provisional application No. 62/298,353, filed on Feb. 22, 2016.

(51) Int. Cl.

| | |
|---|---|
| ***F41A 21/30*** | (2006.01) |
| ***F41A 3/66*** | (2006.01) |
| ***F41A 5/26*** | (2006.01) |
| ***F41C 23/16*** | (2006.01) |
| ***F41A 21/44*** | (2006.01) |
| ***F41G 11/00*** | (2006.01) |
| ***F41A 5/24*** | (2006.01) |
| ***F41A 13/12*** | (2006.01) |
| ***F41A 21/48*** | (2006.01) |

(52) U.S. Cl.

CPC ..... *F41A 21/30* (2013.01); *F41A 3/66* (2013.01); *F41A 5/24* (2013.01); *F41A 5/26* (2013.01); *F41A 13/12* (2013.01); *F41A 21/44* (2013.01); *F41A 21/482* (2013.01); *F41C 23/16* (2013.01); *F41G 11/003* (2013.01)

(58) Field of Classification Search

CPC ..... F41A 21/30; F41A 21/00; F41A 21/02; F41A 21/44; F41A 23/16; F41A 5/26

See application file for complete search history.

(56) References Cited

U.S. PATENT DOCUMENTS

| | | | | |
|---|---|---|---|---|
| 1,195,693 A | | 8/1916 | Lewis | |
| 1,315,504 A | * | 9/1919 | Humm | F41A 21/36 42/71.01 |
| 2,965,994 A | * | 12/1960 | Sullivan | F41C 23/16 42/71.01 |
| 5,062,346 A | * | 11/1991 | Greve Hansen | F41A 21/44 89/14.1 |
| 5,355,765 A | * | 10/1994 | Rogers | F41A 13/12 89/14.4 |
| 7,353,741 B2 | * | 4/2008 | Brixius | F41A 13/06 42/90 |
| 7,832,323 B1 | | 11/2010 | Davies | |

(Continued)

*Primary Examiner* — Benjamin P Lee

(74) *Attorney, Agent, or Firm* — Patterson + Sheridan, LLP

(57) ABSTRACT

An upper receiver assembly includes a barrel, a suppressor body operable to couple to a muzzle end of the barrel, and a first sleeve disposable about the barrel and the suppressor body, wherein the barrel includes one or more longitudinally oriented ribs extending radially from a barrel body having a bore formed therein, and a second sleeve surrounding the first sleeve, the second sleeve comprising a fibrous thermally insulating material.

20 Claims, 16 Drawing Sheets

(56) References Cited

U.S. PATENT DOCUMENTS

| | | | | |
|---|---|---|---|---|
| 8,967,325 | B1 | 3/2015 | Cronhelm | |
| 9,103,618 | B2 * | 8/2015 | Daniel | F41A 21/325 |
| 9,265,318 | B1 * | 2/2016 | Williams | A45C 11/20 |
| D787,003 | S | 5/2017 | Spector et al. | |
| D787,004 | S | 5/2017 | Spector et al. | |
| 9,658,010 | B1 * | 5/2017 | Oglesby | F41A 13/12 |
| 9,658,018 | B1 * | 5/2017 | Heckert | F41A 21/30 |
| 9,677,845 | B2 * | 6/2017 | Cook, Jr. | F41A 21/44 |
| 9,879,933 | B2 * | 1/2018 | Myers | F41A 21/30 |
| 2015/0090105 | A1 | 4/2015 | Pace | |
| 2016/0003570 | A1 * | 1/2016 | Tonkin | F41A 21/02 89/14.4 |
| 2017/0205175 | A1 * | 7/2017 | Garst | F41A 21/30 |

* cited by examiner

HANDGUARD AND BARREL ASSEMBLY WITH SOUND SUPPRESSOR FOR A FIREARM

CROSS-REFERENCE TO RELATED APPLICATIONS

This application claims benefit of U.S. Provisional Patent Application Ser. No. 62/298,353, filed Feb. 22, 2016, which is incorporated by reference herein.

BACKGROUND

Field

Embodiments of the present disclosure generally relate to methods and apparatus for suppressing an auto-loading firearm, and more particularly, a handguard/barrel assembly with a suppressor having improved noise and flash reduction, and improved heat dissipation.

Description of the Related Art

Conventional suppressors or "silencers" are devices that are attached to or built into the barrel of a firearm to reduce the amount of noise, and the amount of visible muzzle flash, generated by firing projectiles from the firearm. Suppressors are currently in use in the civilian population in order to reduce the risk of hearing damage, but are also used in police or military settings to maintain tactical advantage. When a projectile is fired from the firearm, rapidly expanding gases from a propellant (gunpowder) are released from the muzzle of the barrel. These gases may also exit the muzzle at supersonic speeds, or near supersonic speeds, which disturbs the surrounding air and creates a sound of about 160 to 180 decibels as well as a flash from unburnt gunpowder. Suppressors reduce noise by trapping and decelerating the gases from the fired projectile and contain a majority of the flash within a short tube. The trapped, hot gas exits the suppressor at a reduced temperature over an extended period of time and at a greatly reduced velocity, which reduces the noise. The exit path of the gases is typically the same path the hot gases take to enter volumes within the tube except in a reverse direction. As hot gases continue to enter the volumes during rapid firing, less gas is cooled and released, which increases the temperature of the suppressor and any portions of the firearm in the vicinity of, and/or in contact with, portions of the suppressor.

While useful in reducing the noise and light signature of a firearm, suppressors often add unwanted weight, length and mechanical complexity to a firearm. Additionally, conventional suppressors are heated during the firing of the firearm to temperatures that prevent a user from holding the firearm near the suppressor. This heating is increased greatly with rapid rates of fire from the firearm. This creates a safety hazard from burns, or requires a user to wear a glove or other protective equipment, which may interfere with the safe operation and/or accuracy of the firearm. Even after firing is ceased, the suppressor may take many minutes to cool, which may reduce ability of the user to safely handle the firearm.

What is needed is a handguard and barrel assembly that addresses one or more of the challenges discussed above.

SUMMARY

Embodiments of the disclosure provide a firearm with a handguard and barrel assembly having a suppressor that reduces the sound/light signature of the firearm as well as reducing the temperature of portions of the firearm in proximity to the suppressor.

In one embodiment, an upper receiver assembly is disclosed and includes a barrel, a suppressor body operable to couple to a muzzle end of the barrel, and a first sleeve disposable about the barrel and the suppressor body, wherein the barrel includes one or more longitudinally oriented ribs extending radially from a barrel body having a bore formed therein, and a second sleeve surrounding the first sleeve, the second sleeve comprising a fibrous thermally insulating material.

In another embodiment, an upper receiver assembly is disclosed and includes a barrel and an integral suppressor, the barrel and the integral suppressor comprising a unitary body surrounded by a first sleeve and coupled to a barrel nut. The assembly also includes a second sleeve disposed about the first sleeve and being separated by a radial gap formed between the first sleeve and the second sleeve along a longitudinal length of the unitary body. The assembly also includes a handguard disposed about the second sleeve and the barrel nut, wherein air is moved through the gap from a breach end to a muzzle end of the unitary body when a projectile is fired from the suppressor.

In another embodiment, an upper receiver assembly is disclosed and includes a barrel having a barrel body with a bore formed therein and a longitudinally oriented rib extending radially from the barrel body, a suppressor body operably coupled to a muzzle end of the barrel, and a first sleeve disposed about the barrel and the suppressor body, wherein a volume is formed between an outer surface of the barrel body and the interior surface of the first sleeve. The assembly also includes a second sleeve disposed about the first sleeve and being separated from the first sleeve by a radial gap formed between the first sleeve and the second sleeve and extending along a longitudinal length of the barrel body and the suppressor body, and a handguard disposed about the second sleeve.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the disclosure provide a firearm with a handguard and barrel assembly having a suppressor that reduces the sound/light signature of the firearm as well as reducing the temperature of portions of the firearm in proximity to the suppressor. The handguard and barrel assembly may be utilized on conventional auto-loading select-fire firearms such as M4A1 style firearms, M-16 style firearms, AR-10 style firearms, AR-15 style firearms, or other firearms configured to fire repeatedly without reloading after each round is fired. Embodiments disclosed herein include an upper receiver group (including the handguard and barrel assembly with a suppressor (which may be an integral suppressor) that is compatible with existing lower receivers or lower receivers configured similarly to standard lower receivers. Embodiments of the disclosure also provide a handguard and/or a barrel assembly that may be used with a gas or electrically powered firearms, such as airsoft guns, or any firearm capable of firing a projectile.

Embodiments of the disclosure include a suppressor that reduces the sound signature to about 139 decibels (dB) sound pressure level, or less, at the shooters ear. Embodiments of the disclosure also include a handguard and barrel assembly that reduces temperature of the handguard, at the shooters hand position on the handguard, to about 160 degrees Fahrenheit (° F.), or less, after firing 210 rounds at an average firing rate of one round per 2 seconds (+/−0.2 seconds) over 7 minutes (e.g., a "temperature test firing period/rate"). Testing of the handguard and barrel assembly using the temperature test firing period/rate has indicated temperatures of about 95° F. measured at the shooters hand position on the handguard, or less, such about 75° F.

Embodiments of the disclosure also include the handguard and barrel assembly with a suppressor that reduces or eliminates light emissions during firing as well as after firing. Testing of the handguard and barrel assembly with the suppressor has eliminated all light flash in the visible and the infrared (IR) spectrums. The handguard and barrel assembly with the suppressor has also shown elimination of residual system light emissions in the visible and near IR spectrums (as observed with an AN/PVS-31 image intensifier system or AN/PVS-24 image intensifier system) after the firing of 60 rounds within 2 minutes.

Figure 1:
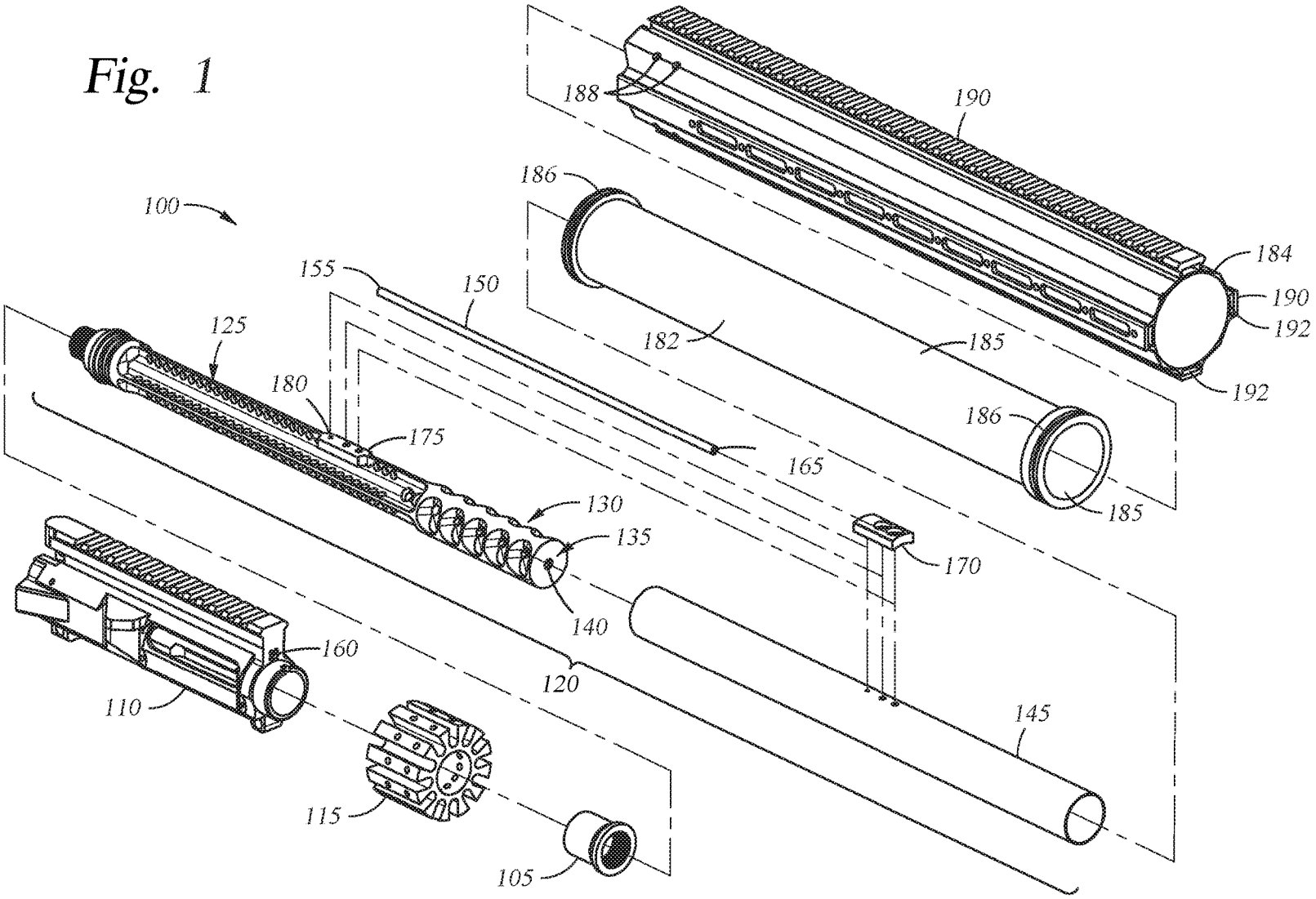
FIG. 1 is an isometric exploded view of an upper receiver assembly according to one embodiment.

FIG. 1 is an isometric exploded view of an upper receiver assembly 100 according to embodiments disclosed herein. The upper receiver assembly 100 is configured to be connected to a compatible lower receiver assembly (not shown) as part of a complete rifle (also not shown). The upper receiver assembly 100 includes a rear spacer ring 105 which couples to an upper receiver 110. A barrel nut 115 couples a barrel/suppressor assembly 120 to the upper receiver 110. The barrel/suppressor assembly 120 includes a barrel 125 having an integral suppressor body 130 positioned at a muzzle end 135 of the barrel 125. While the suppressor body 130 is shown as being integral with the barrel 125 according to some embodiments, the suppressor body 130 may be a distinct device that is adapted to couple to the barrel 125. A bore 140 is formed in the center of the barrel 125 and the suppressor body 130. The bore 140 within the barrel 125 may be rifled to include a desired twist rate while the bore within the suppressor body 130 may be a simple hole. The bore 140 may be any suitable diameter for the desired round (e.g., projectile) to be fired by the upper receiver assembly 100, including wildcat rounds as well as commercially available ammunition or ammunition used by the United States military, such as 5.56 NATO or 0.223 Remington, 7.62 millimeters (mm) or 0.300 inch ammunition (including 0.308 inch), or other suitable ammunition. Rounds also include balls, pellets, BB's, as well as other projectiles.

The barrel/suppressor assembly 120 also includes a first sleeve 145 that is configured to surround the barrel 125 and the barrel/suppressor assembly 120. The first sleeve 145 is configured as a sleeve to contain hot gases when a projectile is fired from the upper receiver assembly 100. The first sleeve 145 may be made of a metallic material having a good strength to weight ratio and a high thermal conductivity. Examples include 4130 chrome-moly or beryllium copper, titanium, or other suitable steels, metals or metallic alloys.

The upper receiver assembly 100 also includes a gas tube 150 having a distal end 155 that is received in a gas port 160 of the upper receiver 110. A proximal end 165 of the gas tube 150 is coupled to a gas block 170. The gas block 170 is coupled to the barrel 125 at a mounting block 175 by fasteners (not shown) that also secures the first sleeve 145 to the barrel 125. A gas vent 180 is formed in the barrel 125 to vent a portion of the gases produced when firing the upper receiver assembly 100. The gases are flowed through the gas block 170 and the gas tube 150 to the upper receiver 110 to facilitate cycling of the upper receiver 110.

The upper receiver assembly 100 also includes a second sleeve 182 that surrounds the first sleeve 145 and a handguard 184 that surrounds the second sleeve 182. The second sleeve 182 is sized to fit tightly within an inner diameter of the handguard 184. The second sleeve 182 may be a thermally insulating tube that minimizes radiation and/or conduction of heat from the first sleeve 145 to the handguard 184. In some embodiments, the second sleeve 182 comprises a tube made of an aluminum material, such as 6063 T6, or titanium, that may contain a thermally insulative material therein. The second sleeve 182 may include the thermally insulative material that is surrounded by a thin inner and outer sidewall 185. In some embodiments, the sidewall 185 comprises a foil material, such as aluminum foil, a titanium foil, or a foil from a material sold under the tradename INCONEL®. The outer sidewall 185 may be contained within a tube made of aluminum, such as 6063 T6, or titanium. The handguard 184 may be made of an aluminum material that may be anodized. In some embodiments, surfaces of the second sleeve 182 may include a coating as described in FIG. 5 below.

In some embodiments, metal to metal contact between the second sleeve 182 and the handguard 184 is minimized or prevented by elastomeric members 186 disposed about each end of the second sleeve 182. The elastomeric members may be flat or round O-rings made a heat resistant material, such as a VITON® elastomer. The handguard 184 and the second sleeve 182 may be coupled to the upper receiver 110 by fasteners (not shown) that are disposed in openings 188 and couple to the barrel nut 115. The handguard 184 includes rails 190 that are positioned radially about the handguard 184 generally at the 3, 6, 9 and 12 o'clock positions. At least one of the rails 190 are mil-spec (MIL-STD-1913) or Picatinny rails, which are commonly used on firearms for mounting lights, lasers, grips and other firearm accessories. In some embodiments, each of the rails 190 include a longitudinally oriented through hole 192.

Unlike conventional firearms with a suppressor, which are designed to contain hot gases and heat, the upper receiver assembly 100 is configured to dissipate heat using multiple inventive concepts as described in more detail below.

Figure 2A:
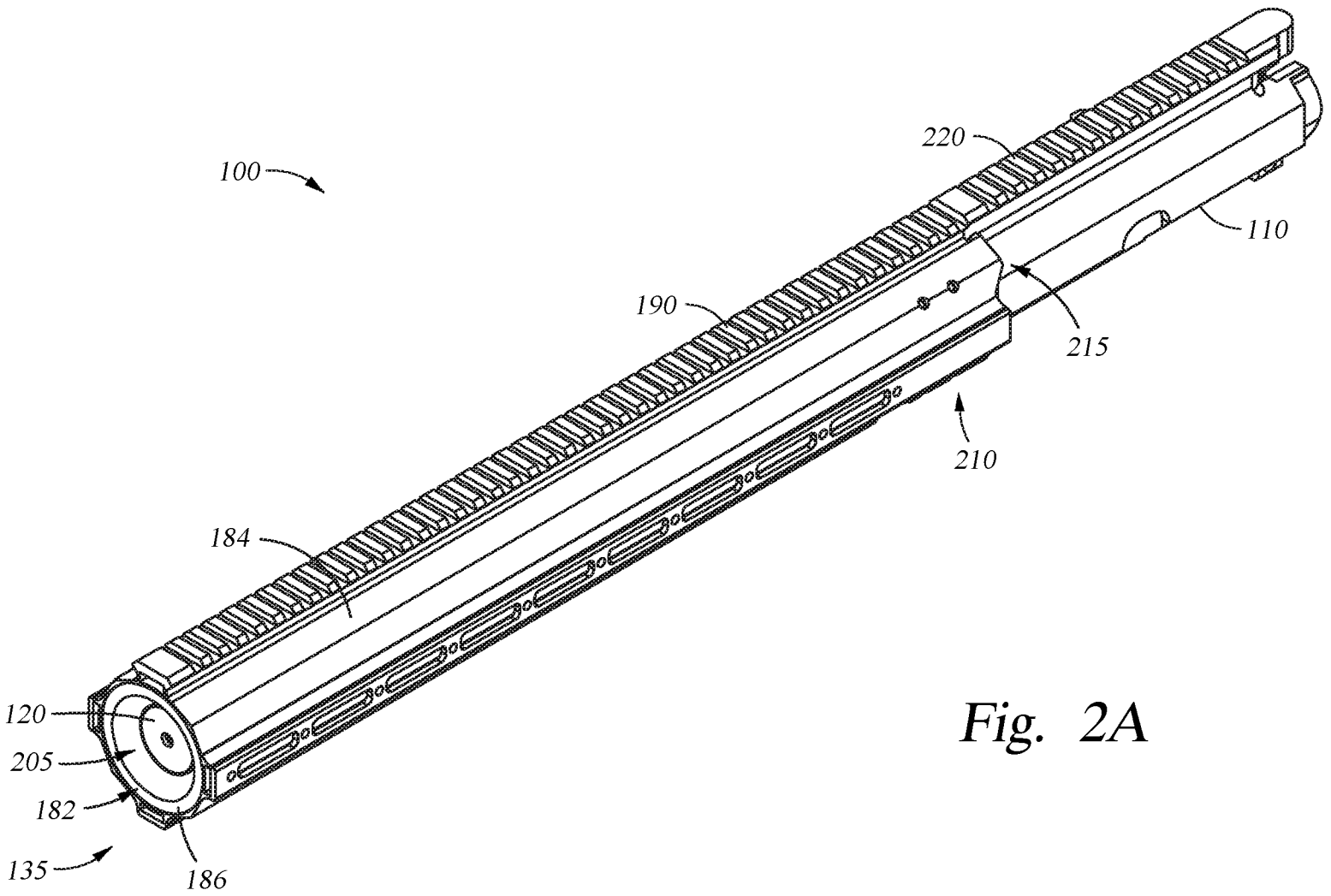
FIGS. 2A and 2B are isometric views of the upper receiver assembly of FIG. 1 assembled.
Figure 2B:
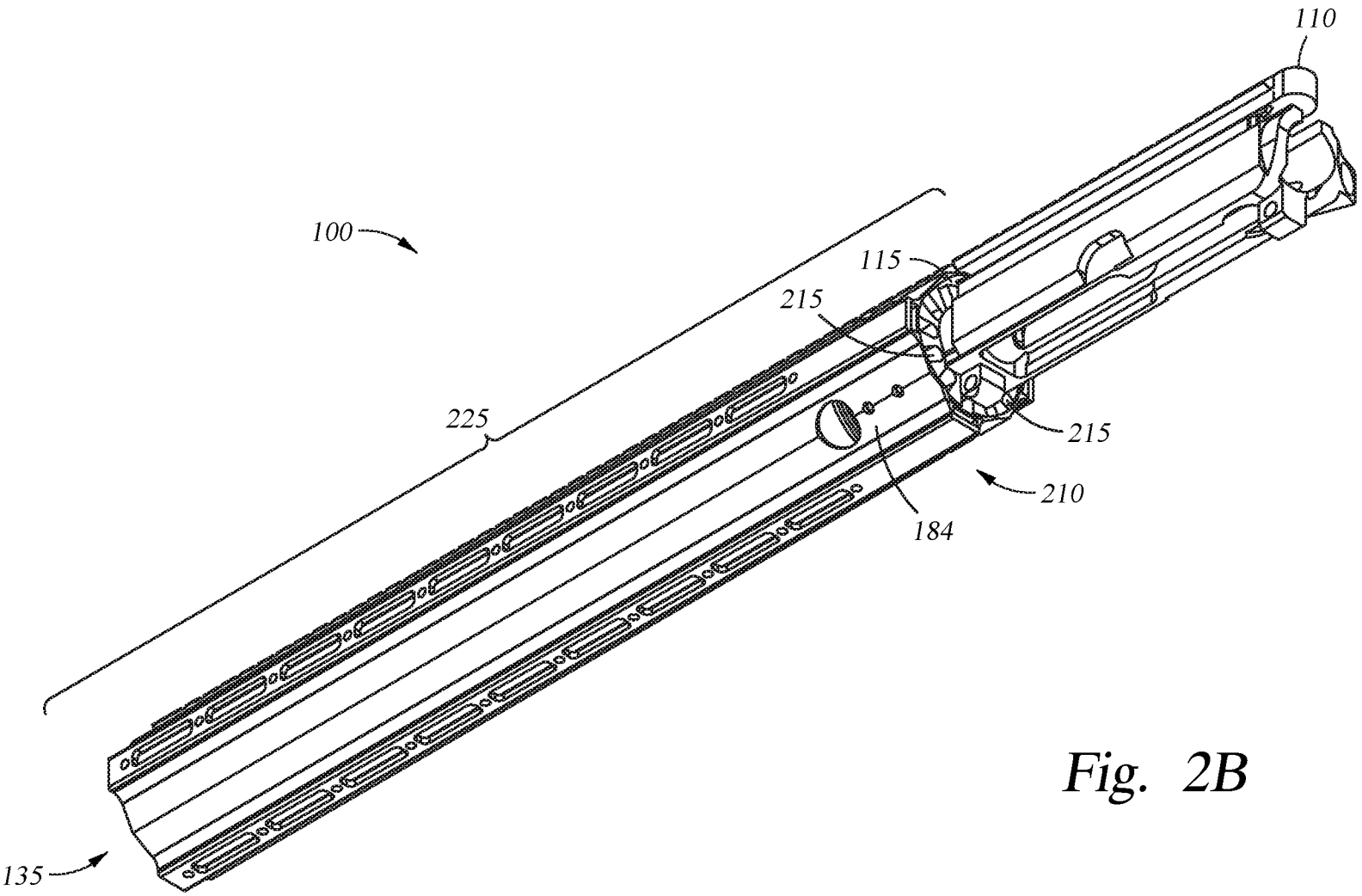

FIGS. 2A and 2B are isometric views of the upper receiver assembly 100 assembled. As shown in FIG. 2A, the assembled upper receiver assembly 100 provides a spacing or radial gap between the second sleeve 182 and the barrel/suppressor assembly 120 forming a volume 205. The spacing may be about 0.5 inches to about 0.625 inches. The volume 205 may be filled with ambient air when the upper receiver assembly 100 is not in use, but ambient air flows through the volume 205 when the upper receiver assembly 100 is fired. The ambient air is utilized to cool the upper receiver assembly 100 whether the upper receiver assembly 100 is in use or is idle.

For example, every time a round is fired, a region of high pressure is formed at the muzzle end 135. At the breach end 210, a lower pressure region exists, and air is pulled through the volume 205 via channels 215 at the breach end 210 (shown in FIGS. 2A and 2B). The channels 215 may be longitudinally oriented grooves formed in the outer surface of the barrel nut 115. The movement of air in the volume serves to remove or dissipate heat from surfaces in fluid communication with the air in the volume 205 (e.g., the first sleeve 145 and the second sleeve 182). Thus, heat is removed each time the upper receiver assembly 100 is fired. In one aspect, the upper receiver assembly 100 uses a Venturi effect or vacuum to move the air in the volume 205, which is described in more detail below. In some embodiments, the barrel/suppressor assembly 120 is recessed within the handguard 184 and/or the second sleeve 182 in order to magnify the Venturi effect. The volume 205 also provides an insulating effect when the upper receiver assembly 100 is not being fired as the air separates the first sleeve 145 and the second sleeve 182. Additionally, the barrel/suppressor assembly 120 and the second sleeve 182 may be cooled by the ambient air in the volume (by, for example, thermal conduction) at a rate faster than conventional suppressed firearms. The insulative effect as well as any thermal conduction may occur if the ambient air in the volume 205 is stagnant or moving slightly (via wind or transport of the firearm). As FIG. 2A also shows, the rail 190 at the 12 o'clock position is aligned with a receiver rail 220 on the upper receiver 110. An overall length 225 of the handguard 184 from the breach end 210 to the muzzle end 135 may be about 18 inches, or less, in some embodiments.

Figure 3A:
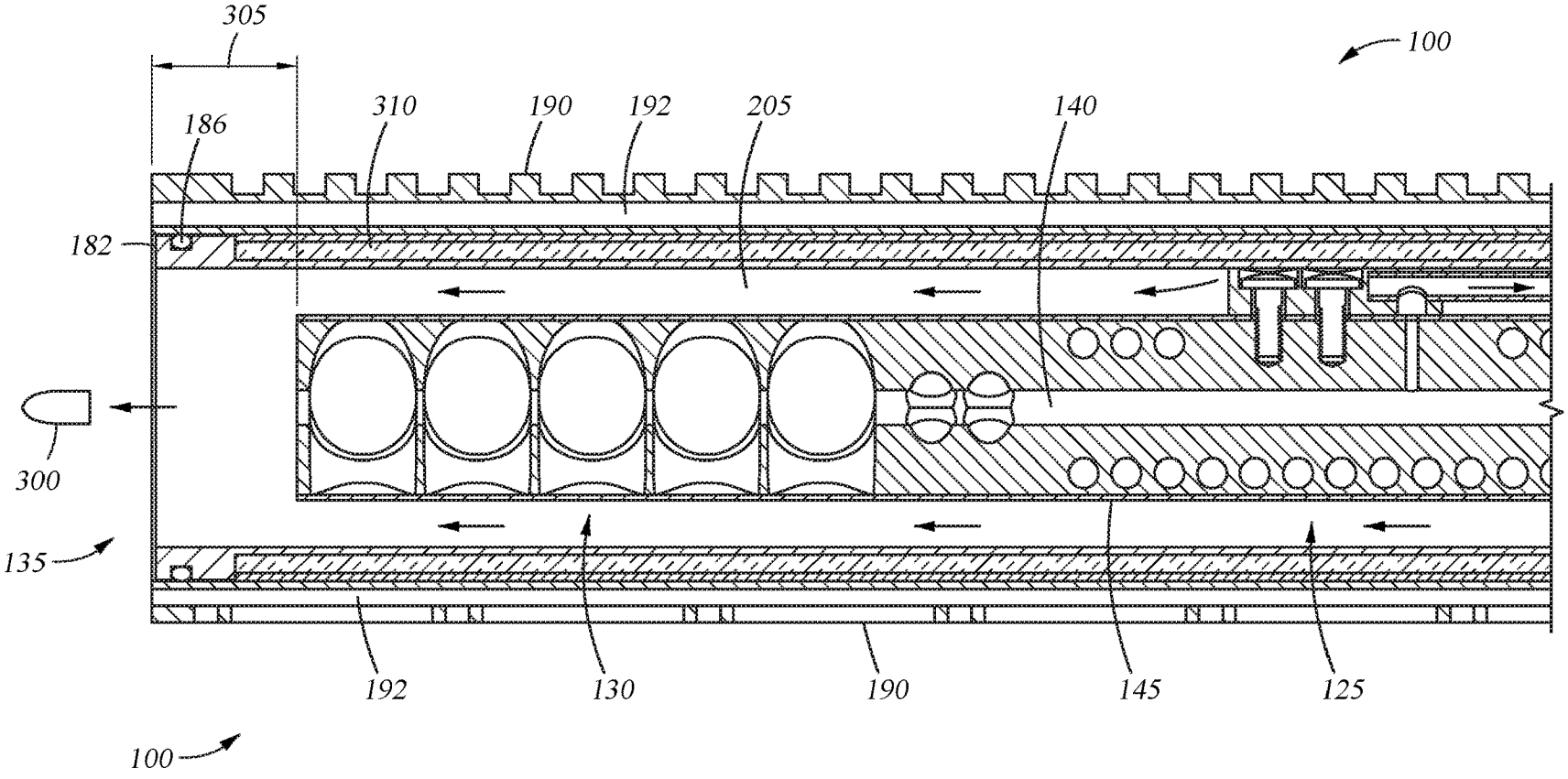
FIGS. 3A and 3B are cross-sectional views of the upper receiver assembly showing air flow paths when a projectile is fired from the upper receiver assembly.
Figure 3B:
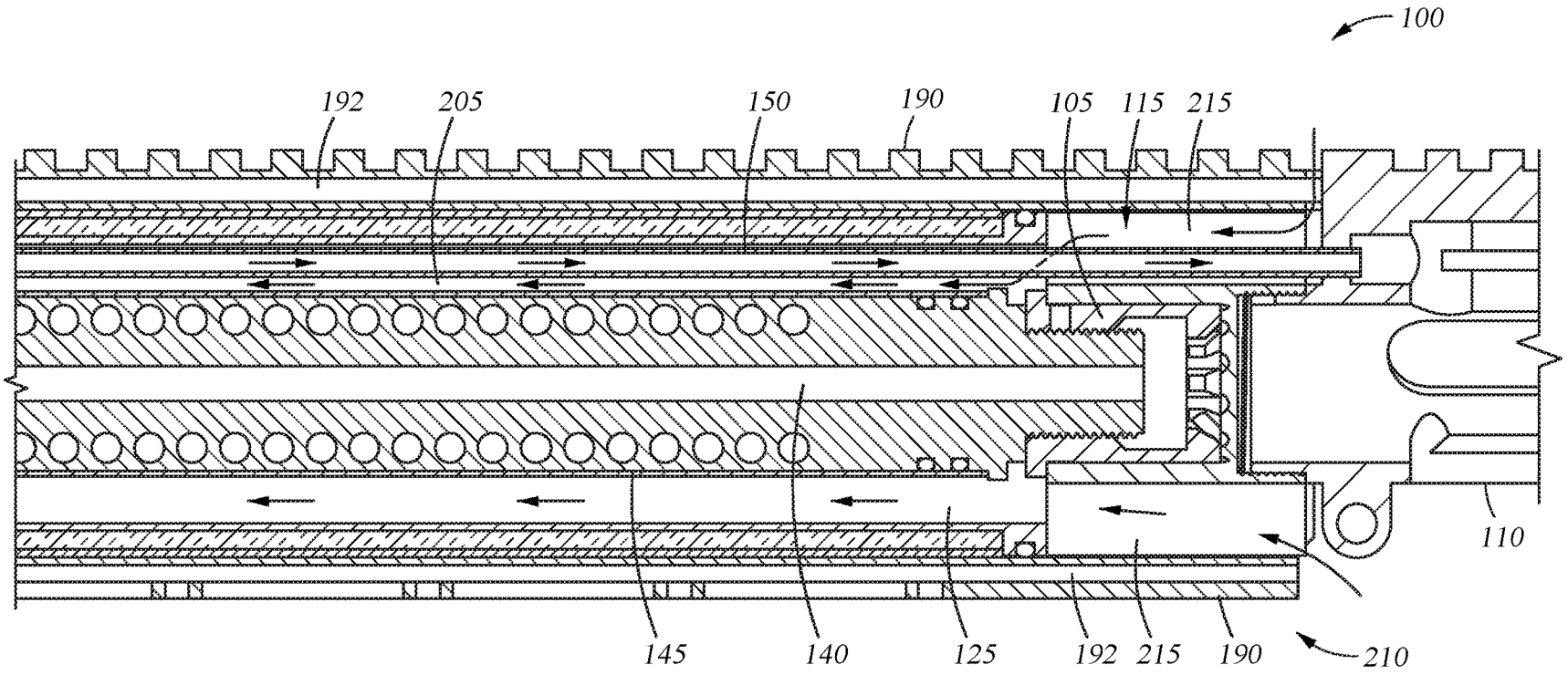

FIGS. 3A and 3B are cross-sectional views of the upper receiver assembly 100 showing air flow paths when a projectile 300 is fired from the upper receiver assembly 100. Air enters the channels 215 after the projectile 300 exits the bore 140 to cool the first sleeve 145 and the second sleeve 182. FIG. 3 also shows a recess depth 305, which may be about 0.5 inches to about 1 inch. Also shown is an interior of the second sleeve 182, which contains a thermally insulating material 310. The thermally insulating material 310 may be a lightweight aerogel with one or a combination of flexibility, hydrophobic properties and a low thermal conductivity or a thermal ceramic material. Examples include flexible or fabric insulation (fibrous material) sold under the tradename PYROGEL® or a ceramic fiber sold under the tradename SUPERWOOL®.

The upper receiver assembly 100 is designed to drain and be fully functional after being fully submerged in water, and has a drain time of about less than 3 seconds, for example, about 1.5 seconds. As most of the upper receiver assembly 100 is open at the muzzle end 135 and the breach end 210, water can drain very quickly. The thermally insulating material 310, which may resemble a fabric in some embodiments, is sealed by the elastomeric members 186. Additionally, in embodiments where the thermally insulating material 310 is hydrophobic, any water that may enter the second sleeve 182 will not be absorbed. In some embodiments, the sidewalls 185 of the second sleeve 182 may include a coating as described in FIG. 5 below.

As the barrel/suppressor assembly 120 is configured to dissipate heat by radiation and/or conduction using the ambient air in the volume 205, the second sleeve 182 and the thermally insulating material 310 may be used as a heat shield for the handguard 184. However, any heat that may be transferred to the handguard 184 is mitigated by the through holes 192. The through holes 192 serve to reduce the thermal mass of the handguard 184 while additionally providing a volume for ambient air to contact a larger surface area of the handguard 184. The larger surface area provided by the through holes 192 tends to dissipate heat faster and more efficiently as compared to conventional handguards, and results in maintaining a safe operating temperature for the handguard 184.

Figure 4A:
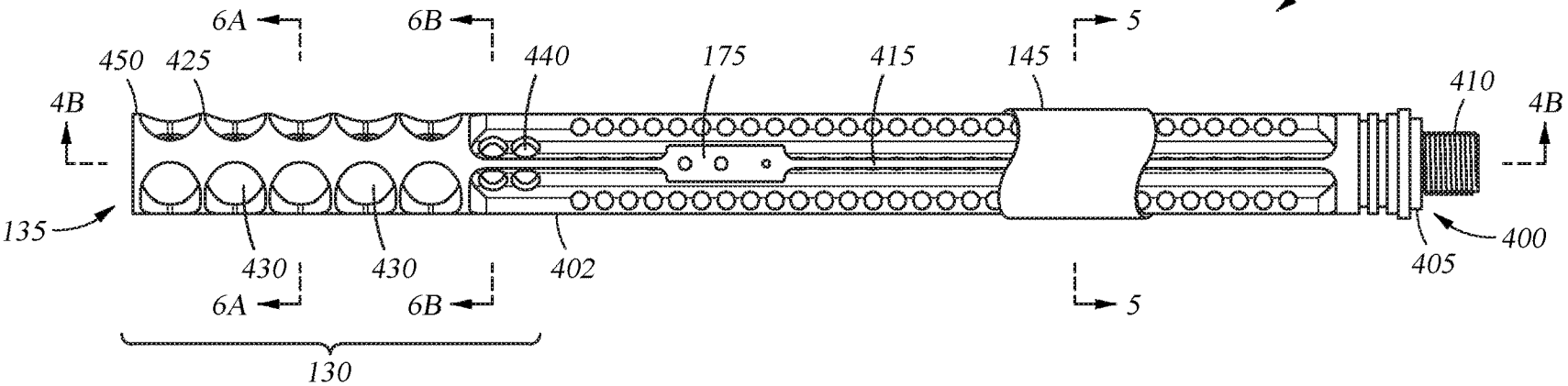
FIG. 4A is a side view of a barrel and a suppressor body of the upper receiver assembly.
Figure 4B:
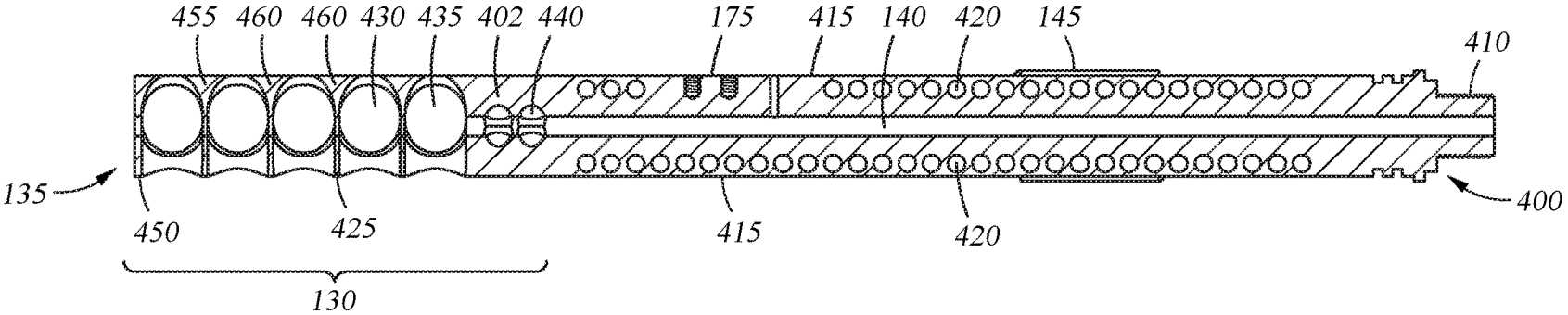
FIG. 4B is a cross-section of the barrel and the suppressor body along line 4B-4B of FIG. 4A.
Figure 4C:
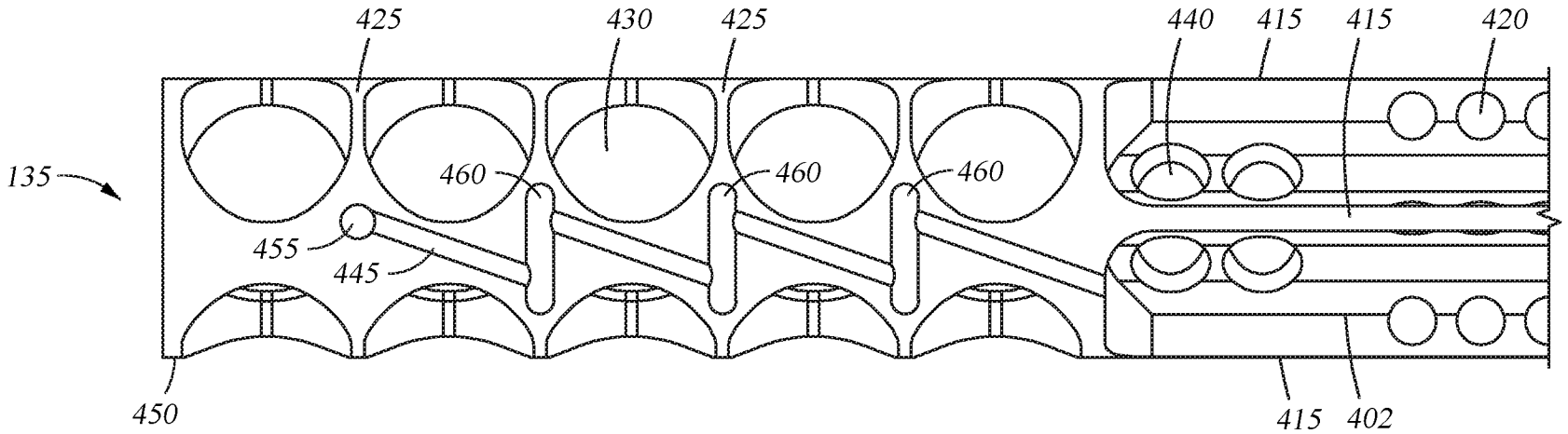
FIG. 4C is an enlarged side view of another embodiment of the suppressor body.
Figure 5:
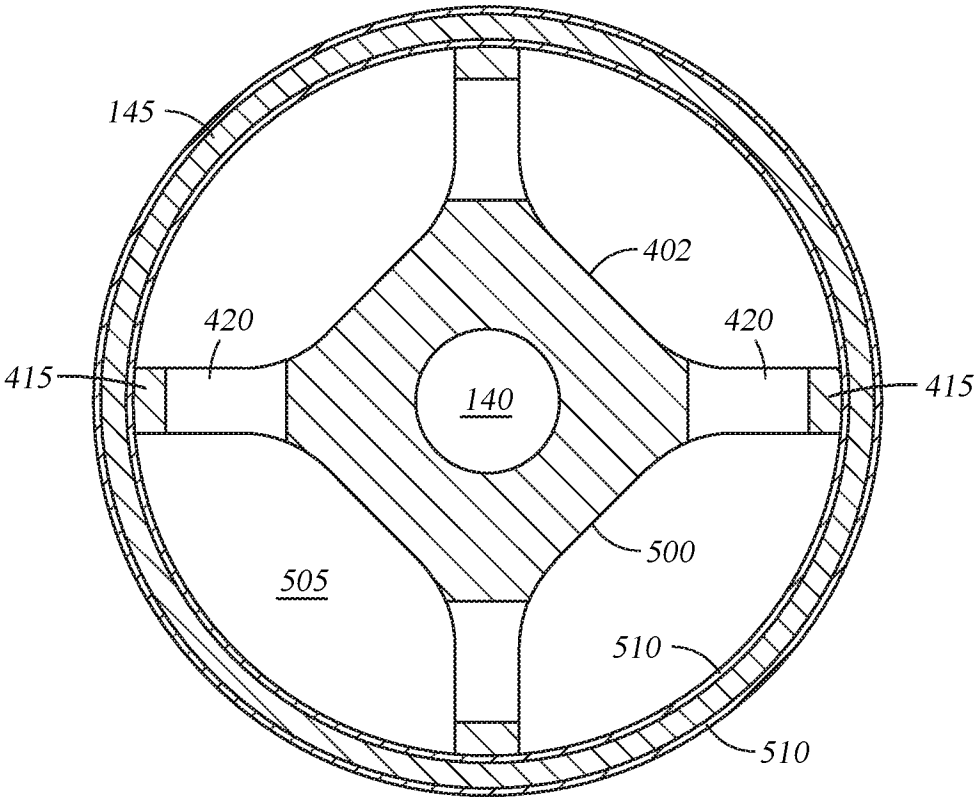
FIG. 5 is an axial cross-section of the barrel along line 5-5 of FIG. 4A.
Figure 6B:
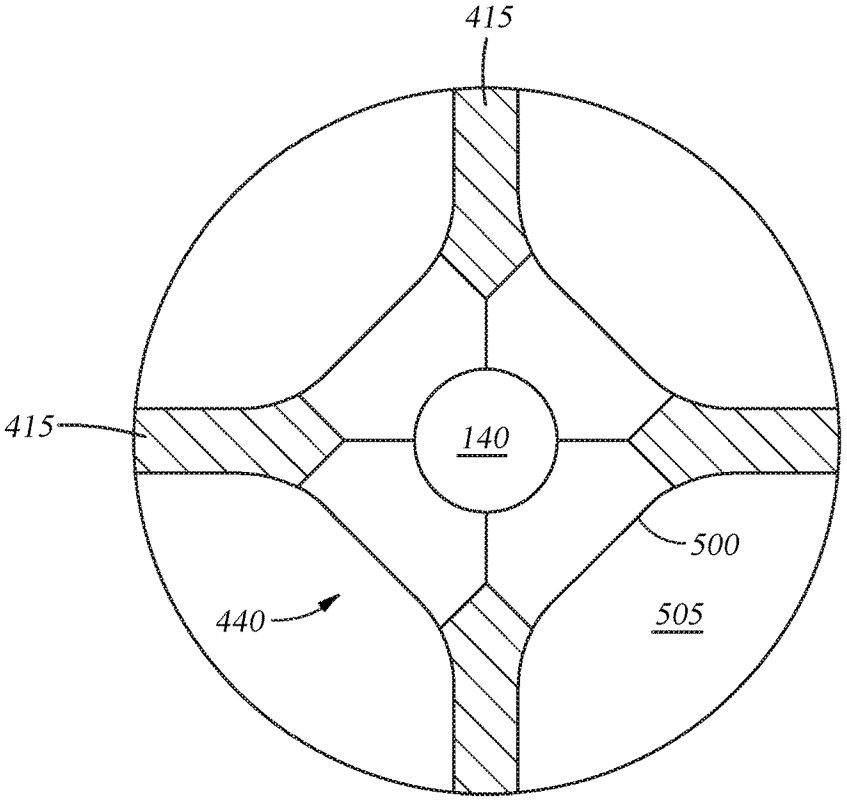
FIG. 6B is an axial cross-section of the suppressor body along line 6B-6B of FIG. 4A.
Figure 6A:
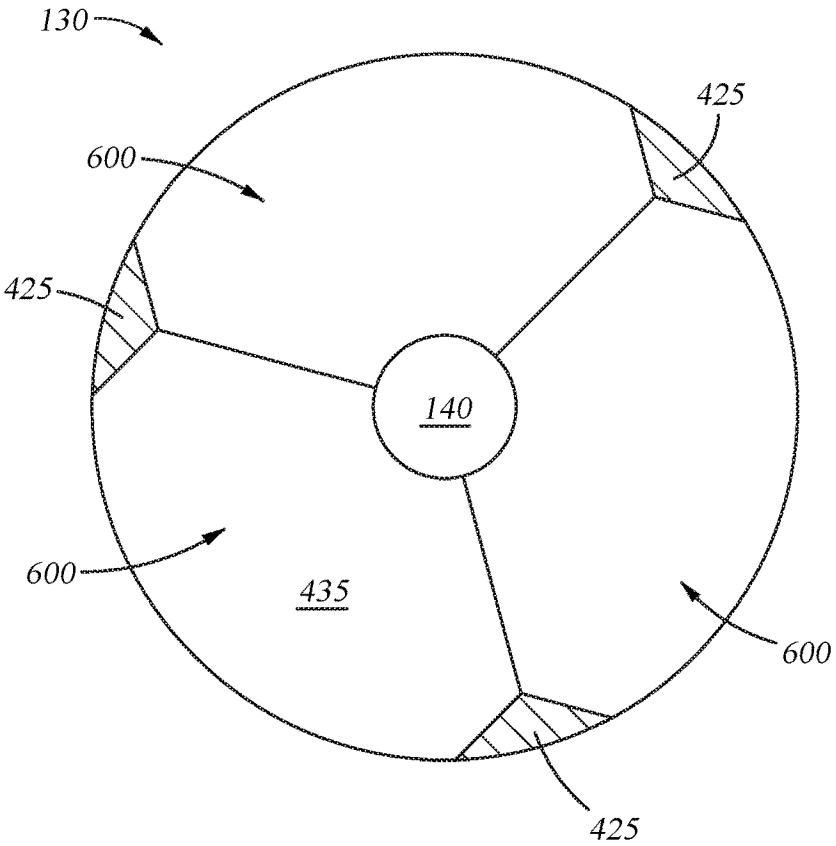
FIG. 6A is an axial cross-section of the suppressor body along line 6A-6A of FIG. 4A.

FIGS. 4A-4C, 5, 6A, and 6B are various views of the barrel 125 and the suppressor body 130. FIG. 4A is a side view of the barrel 125 and the suppressor body 130 and FIG. 4B is a cross-section along line 4B-4B of FIG. 4A. A portion of the first sleeve 145 is shown in FIGS. 4A and 4B. FIG. 4C is an enlarged side view of another embodiment of the suppressor body 130. FIG. 5 is an axial cross-section along line 5-5 of FIG. 4A. FIG. 6A is an axial cross-section along line 6A-6A of FIG. 4A and FIG. 6B is an axial cross-section along line 6B-6B of FIG. 4A.

The barrel 125 includes a breach end 400 that extends to the muzzle end 135 of the suppressor body 130. In one embodiment, the barrel 125 and the suppressor body 130 comprise an integral body 402 that may be machined from of a single piece of stock in multiple operations. The body 402 includes a collar 405 at the breach end 400 with a threaded portion 410 that interfaces with the spacer ring 105 (shown in FIG. 1). The body 402 may be made from a stainless steel material having a low coefficient of thermal expansion (linear) and good corrosion resistance. Examples include austenitic alloys containing silicon and/or manganese, as well as enhanced thermal conduction (as compared with other stainless steel materials). Other examples include stainless steels that work harden at temperatures experienced when firing multiple rounds at a high fire rate from the upper receiver assembly 100. Heat generated in the suppressor body 130 may be conducted along the length of the barrel 125 toward the breach end 400, which is relatively cooler than the muzzle end 135 during initial firing of the weapon. Heat will generally dissipate throughout the entire length of the barrel and into the upper and lower receiver. Thus, heat is dissipated along portions of the body 402 that are cooler than the suppressor body 130. In one embodiment, the body 402 is made from a stainless steel alloy sold as NITRONIC 60® which can tolerate more heat than typical 416R stainless steel or 4140 and 4150V chrome-moly alloy which typically warps under high heat conditions from a propellant inside the bore of the barrel.

The body 402 includes one or more longitudinally oriented ribs 415 provided along a length of the barrel 125 to the suppressor body 130 (only three are shown in FIG. 4A). As shown in FIG. 5, four ribs 415 are radially positioned equally along from a barrel body 500. The ribs 415 may be positioned generally at the 3, 6, 9 and 12 o'clock positions. A volume 505 is formed between the surfaces of the ribs 415, the barrel body 500 and the interior surface of the first sleeve 145. The volume 505 may be a combustion chamber that serves to contain gases produced when a projectile is fired from the upper receiver assembly 100 as explained in greater detail below.

Referring again to FIGS. 4A, 4B, and 5, a plurality of through holes 420 may be formed in the ribs 415 in a direction that is generally orthogonal to the longitudinal direction of the body 402. The through holes 420 may be utilized to increase the volume 505 and/or reduce the weight of the body 402.

As shown in FIG. 5, which may be utilized in some embodiments, one or both of the outer diameter surface and inner diameter surface of the first sleeve 145 includes a coating 510. The coating 510 may be a ceramic material that is adhered to the respective surfaces of the first sleeve 145. The coating 510 may be aluminum titanium nitride (AlTiN) that is deposited on the first sleeve 145 by a physical vapor deposition (PVD) process, a chemical vapor deposition (CVD) process, or other suitable deposition process. The coating 510 may include a thickness of about 2 microns (μm) to about 10 μm. In some embodiments, the AlTiN converts to aluminum oxide ($AlO_3$) at temperatures above about 250° F. For example, when about three to four rounds are fired in succession at a certain rate, the temperature of the first sleeve 145 is elevated and converts the AlTiN to $AlO_3$ in some embodiments.

Referring to FIGS. 4A, 4B and 6A, the suppressor body 130 includes multiple baffles 425 formed between first openings 430. In one embodiment, the first openings 430 may be substantially circular holes formed in a direction that is substantially orthogonal to the longitudinal direction of the body 402. In other embodiments, the holes may be oval-shaped (longer along the radial direction relative to the longitudinal direction). As shown in FIG. 6A, each first opening 430 may include three holes 600 that are machined into the suppressor body 130 at 120 degree angles relative to the longitudinal direction of the suppressor body 130, and meet at a center of the suppressor body 130 (e.g., in the plane of the bore 140). The first openings 430 form volumes 435 when bounded by the first sleeve 145 and the volumes 435 allow gases to expand and cool when a projectile is fired.

Referring to FIGS. 4A, 4B and 6B, the suppressor body 130 also includes a plurality of second openings 440 that are not separated by baffles such that the second openings 440 are in direct fluid communication with the volume 505 (shown and described in FIG. 5).

When a projectile (e.g., a bullet (not shown)) is fired, the projectile travels along the bore 140 from the breach end 400 towards the muzzle end 135 by an ignited propellant. Expanding gases from the propellant, as well as un-combusted propellant that ignites within the bore 140, create a high pressure behind the projectile to push the projectile through the bore 140 at a high velocity. Upon exiting the barrel 125, the projectile enters the suppressor body 130. As the projectile passes the second openings 440, the combusted (and combusting) gases expand radially through the second openings 440 and are directed toward the breach end 400 and expand in the volume 505. Combustion gases quickly (within milliseconds) expand throughout the volume 505. As the projectile continues through suppressor body 130 toward the muzzle end 135, combustion gases propelling the projectile expand outward into each consecutive first opening 430. Combustion gases substantially contained within the volume 505 and the volumes 435 of the first openings 430 for a short time period. After the projectile exits the suppressor body 130, the combustion gases are vented from the volume 505 and the volumes 435 via the bore 140.

Additionally, the combustion gases are vented from the volume 505 by a channel 445 formed in an outer surface 450 of the suppressor body 130 (shown in FIG. 4C). The channel 445 may be a depression or groove formed in the outer surface 450 in a generally longitudinal direction. The channel 445 allows gases to flow between the first sleeve 145 and the outer surface 450 of the suppressor body 130, effectively allowing the suppressor body 130 to expel gases faster. The channel 445 is in fluid communication with the volume 505 and a vent 455 (shown in FIG. 4C) that is in fluid communication with the bore 140. While only one channel 445 is shown, the outer surface 450 of the suppressor body 130 may include three channels 445 at about 120 degree intervals (i.e., between the first openings 430). Initially redirecting combustion gases into the volume 505 allows the combustion gases to rapidly expand and disperse within the large volume of space behind the suppressor body 130, which decelerates the combustion gases before ultimately venting back through, and/or around, the suppressor body 130.

The vent 455 may be formed as a through hole machined in a radial direction between the outer surface 450 of the suppressor body 130 and the bore 140. The channel 445 may include a plurality of cross-grooves 460 (shown in FIG. 4C) that are in fluid communication with each of the volumes 435 (shown in FIG. 4B) such that gases in the volumes 435 may flow therebetween. The cross-grooves 460 may also be in fluid communication with the channel 445. The cross-grooves 460 may provide a channel having a zig-zag configuration.

Figure 7:
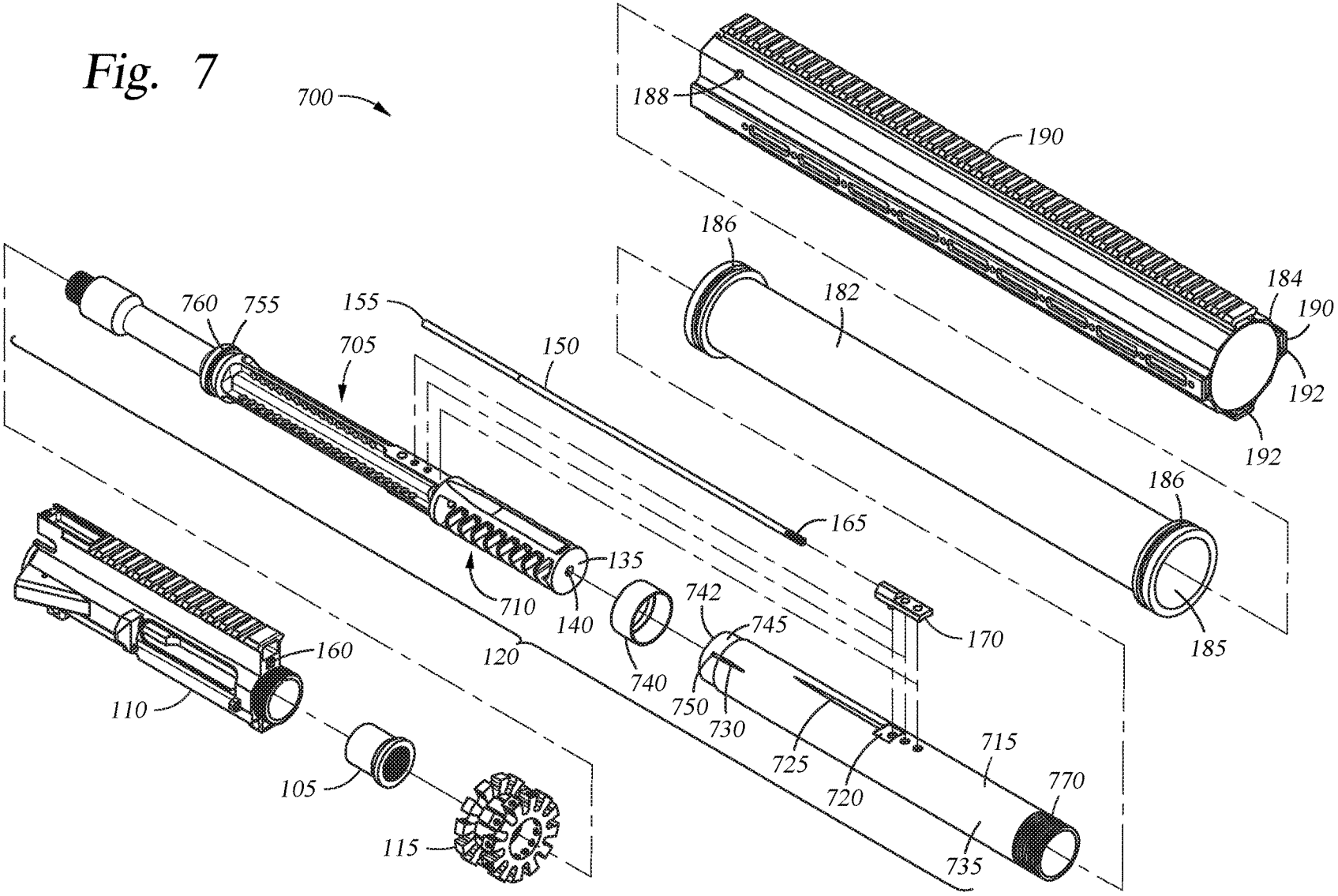
FIG. 7 is an isometric exploded view of an upper receiver assembly according to another embodiment.

FIG. 7 is an isometric exploded view of an upper receiver assembly 700 according to another embodiment. The upper receiver assembly 700 is similar to the embodiment shown in FIG. 1 and some parts thereof are not described in detail for brevity. The upper receiver assembly 700 includes: the rear spacer ring 105 which couples to the upper receiver 110, and the barrel nut 115 which couples the barrel/suppressor assembly 120 to the upper receiver 110. The barrel/suppressor assembly 120 according to this embodiment includes a barrel 705 having an integral suppressor body 710 positioned at a muzzle end 135 of the barrel 705. The barrel 705 and the suppressor body 710 are modified from the embodiment disclosed in FIG. 1 and details thereof are discussed below. While the suppressor body 710 is shown as being integral with the barrel 705 according to some embodiments, the suppressor body 710 may be a distinct device that is adapted to couple to the barrel 705. A bore 140 is formed in the center of the barrel 705 and the suppressor body 710. The bore 140 may be configured as described above in FIG. 1.

The barrel/suppressor assembly 120 is similar to the embodiment of FIG. 1 with the following exceptions. A first sleeve 715 is configured to surround the barrel 705 and the barrel/suppressor assembly 120. The first sleeve 715 according to this embodiment may include a radial recess 720 to receive a portion of the gas block 170 therein. The first sleeve 715 according to this embodiment may also include one or more longitudinal recesses 725 and 730 that are formed in an outer surface 735 of the first sleeve 715. The longitudinal recess 725 may be utilized to receive at least a portion of the gas tube 150.

The first sleeve 715 according to this embodiment may include an end cap 740 that couples to a breach end 742 of the first sleeve 715. The breach end 742 of the first sleeve 715 may include a circular recess 745 that has a diameter that is substantially the same as an inside diameter of the end cap 740. When assembled, an outer diameter of the end cap 740 may be substantially coplanar with the outer surface 735 of the first sleeve 715. The breach end 742 of the first sleeve 715 may also include one or more gas ports 750. The gas ports 750 may be utilized to vent gases from an interior of the first sleeve 715 to an exterior of the first sleeve 715 as will be explained in greater detail below. The breach end 742 of the first sleeve 715 is adapted to fit snugly over a shoulder 755 of the barrel 705 when assembled. Elastomeric seals 760, such as O-rings, may be used to prevent gases from exiting the breach end 742 of the first sleeve 715 (other than through the one or more gas ports 750). The one or more longitudinal recesses 730 may be aligned with the one or more gas ports 750 in some embodiments, and may be used to channel gases exiting the interior of the first sleeve 715. The first sleeve 715 may be made of the materials described in the embodiment of FIG. 1. In some embodiments, the first sleeve 715 includes a threaded portion 770. The threaded portion 770 may be utilized to attach devices to the barrel/suppressor assembly 120. For example, the threaded portion 770 may be utilized to attach a blank fire adapter (not shown) that is typically utilized in training exercises. Other portions of the upper receiver assembly 700 are similar to the embodiment described in FIG. 1 and will not be repeated for brevity.

Figures 8, 9:
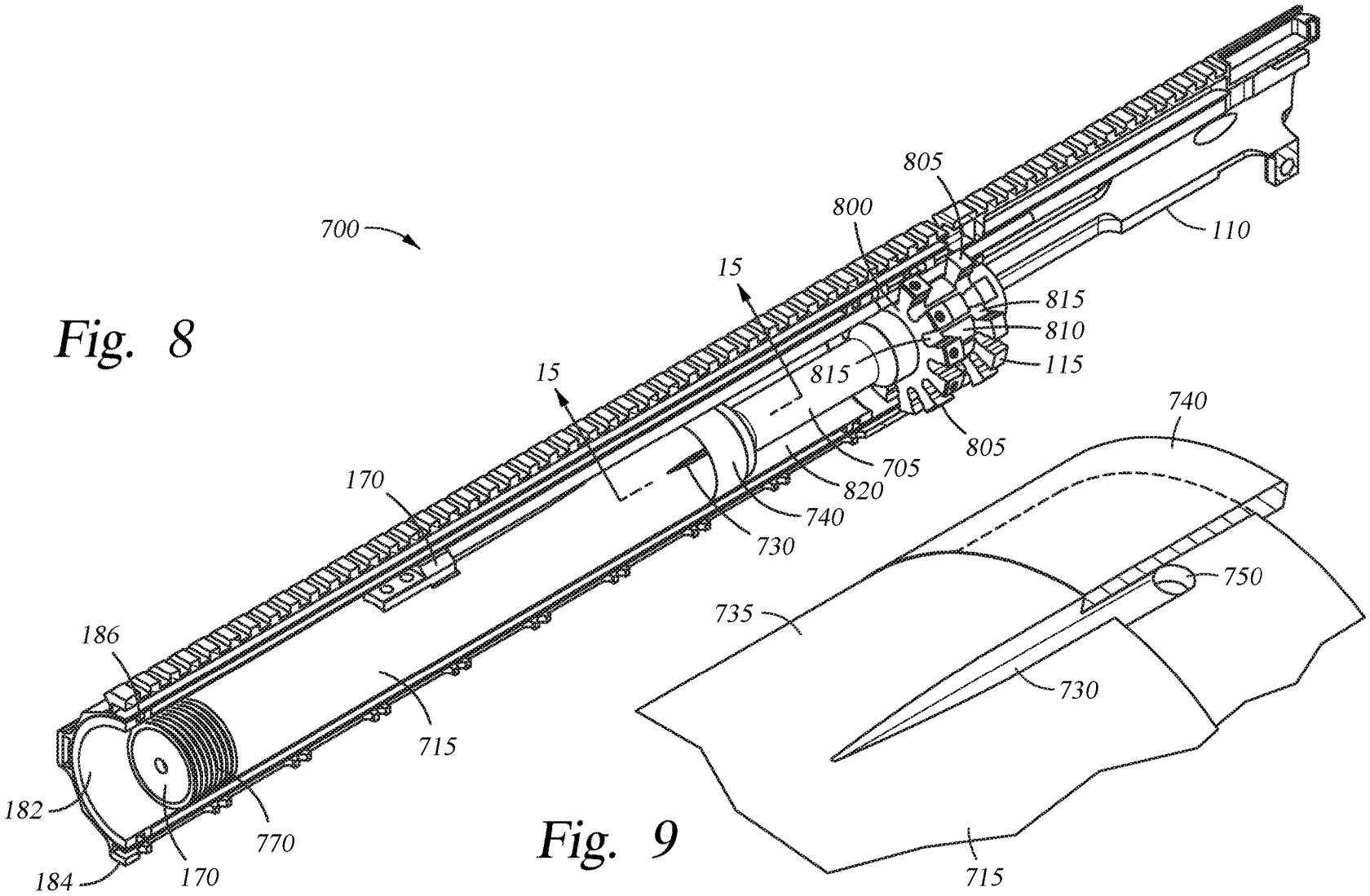
FIG. 8 is an isometric partial cutaway view of the upper receiver assembly shown in FIG. 7 assembled.
FIG. 9 is an enlarged view of the first sleeve and the end cap of FIG. 8.

FIG. 8 is an isometric view of the upper receiver assembly 700 shown in FIG. 7 assembled. A portion of the handguard 184 and the second sleeve 182 is cutaway to show the first sleeve 715, the end cap 740 and a portion of the barrel 705.

FIG. 9 is an enlarged view of the first sleeve 715 and the end cap 740. A portion of the end cap 740 is cutaway to show one of the gas ports 750. The longitudinal recess 730 may be a groove formed in the outer surface 735 of the first sleeve 715. While only one gas port 750 and longitudinal recess 730 is shown in the view of FIGS. 8 and 9, the first sleeve 715 may include two, three, four, or more gas ports and recesses. The longitudinal recess 730 gradually increases in depth from the outer surface 735 of the first sleeve 715 to the gas port 750. In operation, gases from the interior of the first sleeve 715 exit the gas ports 750 and flow through the longitudinal recesses 730. The number and/or size of the gas ports 750 may be chosen based on pressure needed for operation of the upper receiver assembly 700. For example, the size of the gas ports 750 may be large as long as sufficient gas pressure is maintained for cycling of rounds.

The barrel nut 115 according to this embodiment includes a body 800 having a plurality of radially oriented fins 805 extending therefrom. The radially oriented fins 805 are separated longitudinally by a longitudinally oriented channel 810 in fluid communication with air gaps 815 formed between adjacent radially oriented fins 805. In operation, the air gaps 815 are configured to allow passage of air from outside of the handguard 184 (e.g., ambient air surrounding the upper receiver assembly 700) to an interior volume 820. Air flow in the upper receiver assembly 700 will be described in greater detail below.

Figure 10:
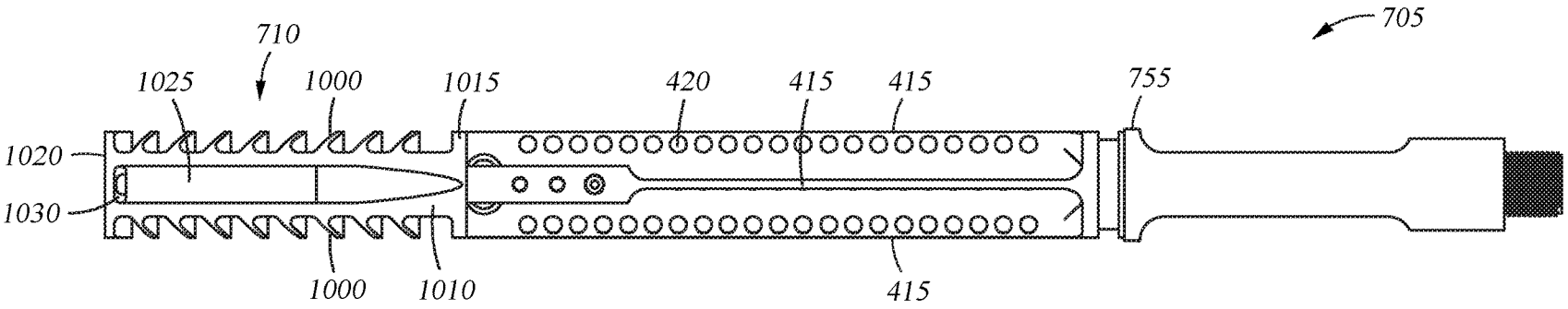
FIG. 10 is a top plan view of the barrel with the first sleeve removed.
Figure 11:
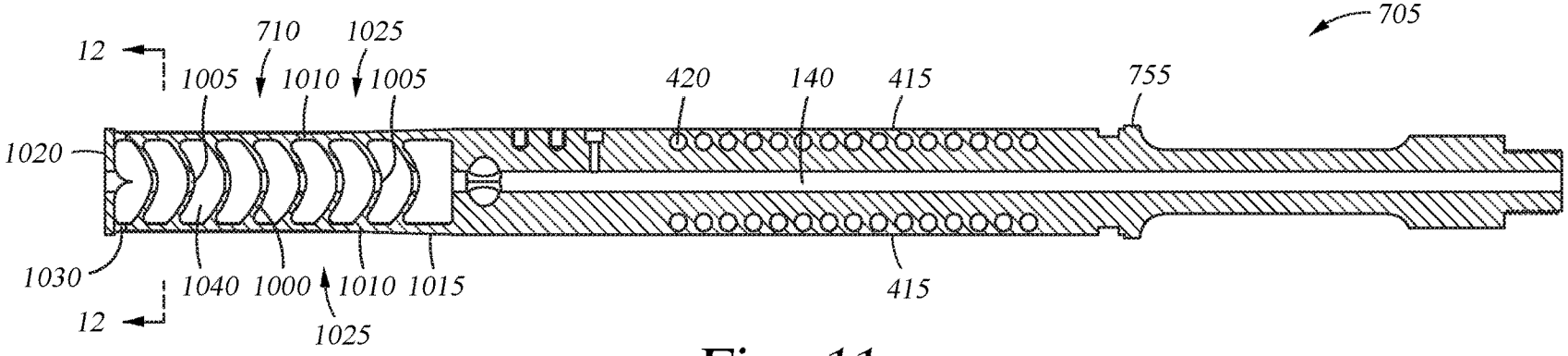
FIG. 11 is a cross-sectional view of the barrel of FIG. 10 rotated 90 degrees.
Figure 12:
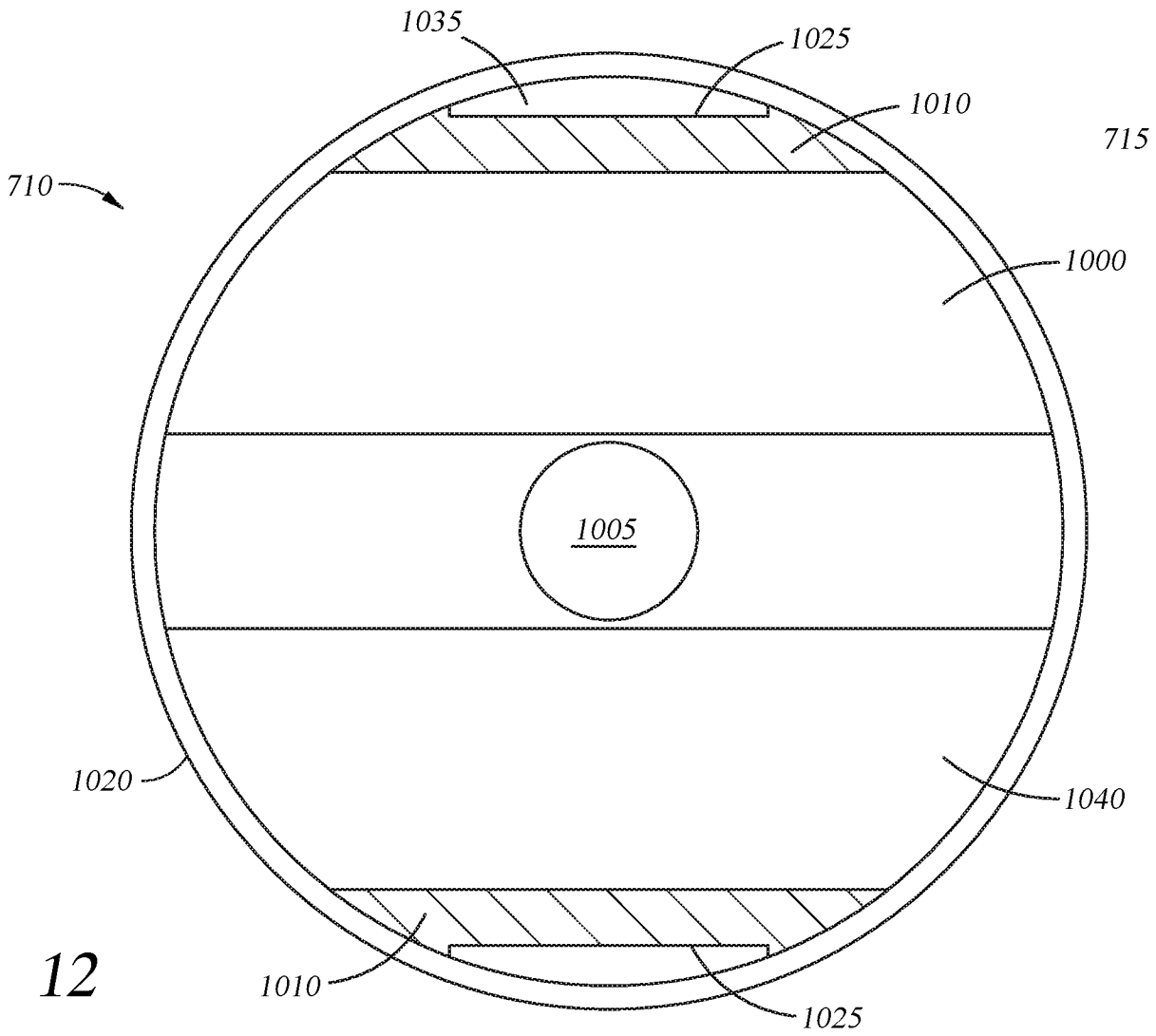
FIG. 12 is a cross-sectional view of the suppressor body along lines 12-12 of FIG. 11.

FIG. 10 is a top plan view of the barrel 705 with the first sleeve 715 removed. FIG. 11 is a cross-sectional view of the barrel 705 of FIG. 10 rotated 90 degrees. FIG. 12 is a cross-sectional view of the suppressor body 710 along lines 12-12 of FIG. 11.

The suppressor body 710 according to this embodiment includes a plurality of baffles 1000 that have a curved cross-section. Each baffle 1000 includes an opening 1005 that is aligned with the bore 140 of the barrel 705. The baffles 1000 are coupled to each other by walls 1010 that extend between a breach plate 1015 and a muzzle plate 1020. The curved cross-section of the baffles 1000 increases the surface area of the baffles. In operation, the increased surface area serves to increase a vortex of gasses and/or increases the travel time of gasses within the suppressor body 710. In some embodiments, the walls 1010 include a longitudinally oriented groove 1025. A depth of the groove 1025 may increase from the breach plate 1015 to the muzzle plate 1020. The groove 1025 may terminate at an opening 1030 adjacent to the muzzle plate 1020. When the first sleeve 715 is disposed about a circumference of the suppressor body 710, an outer volume 1035 (shown in FIG. 12) is formed between the grooves 1025 and an interior surface of the first sleeve 715. In operation, gasses from an interior volume 1040 of the suppressor body 710 may flow to the outer volume 1035 through the openings 1030. Thus, in one embodiment, the outer volume 1035 acts as a reflux chamber to alleviate pressure from the interior volume 1040 of the suppressor body 710, which may prevent an implosion.

Figure 13A:
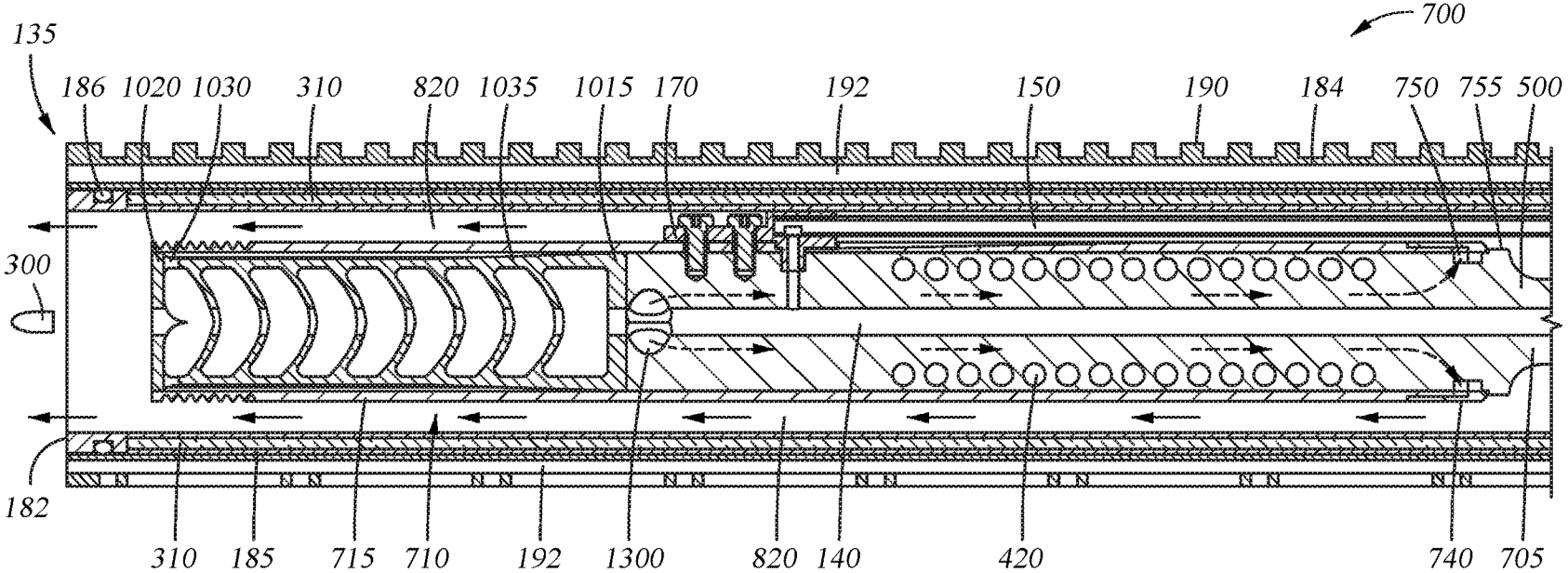
FIGS. 13A and 13B are cross-sectional views of the upper receiver assembly shown in FIG. 7.
Figure 13B:
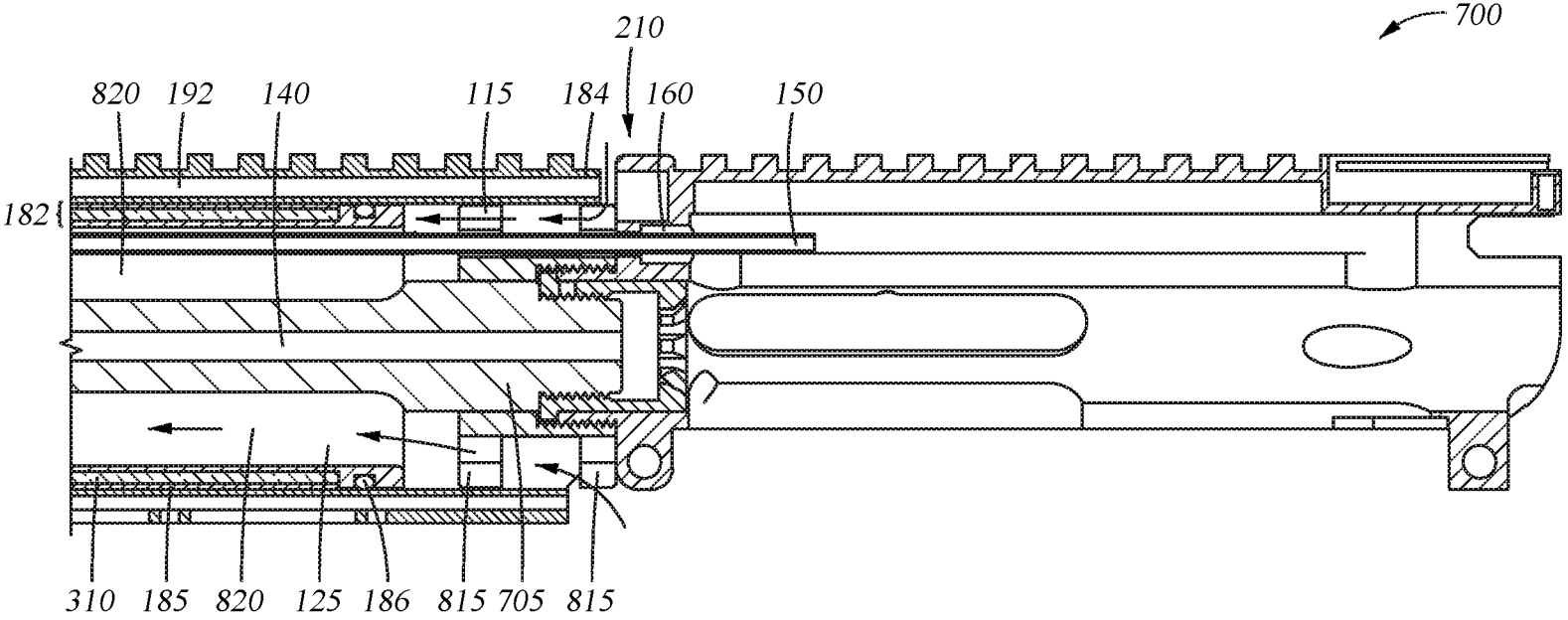
Figure 14:
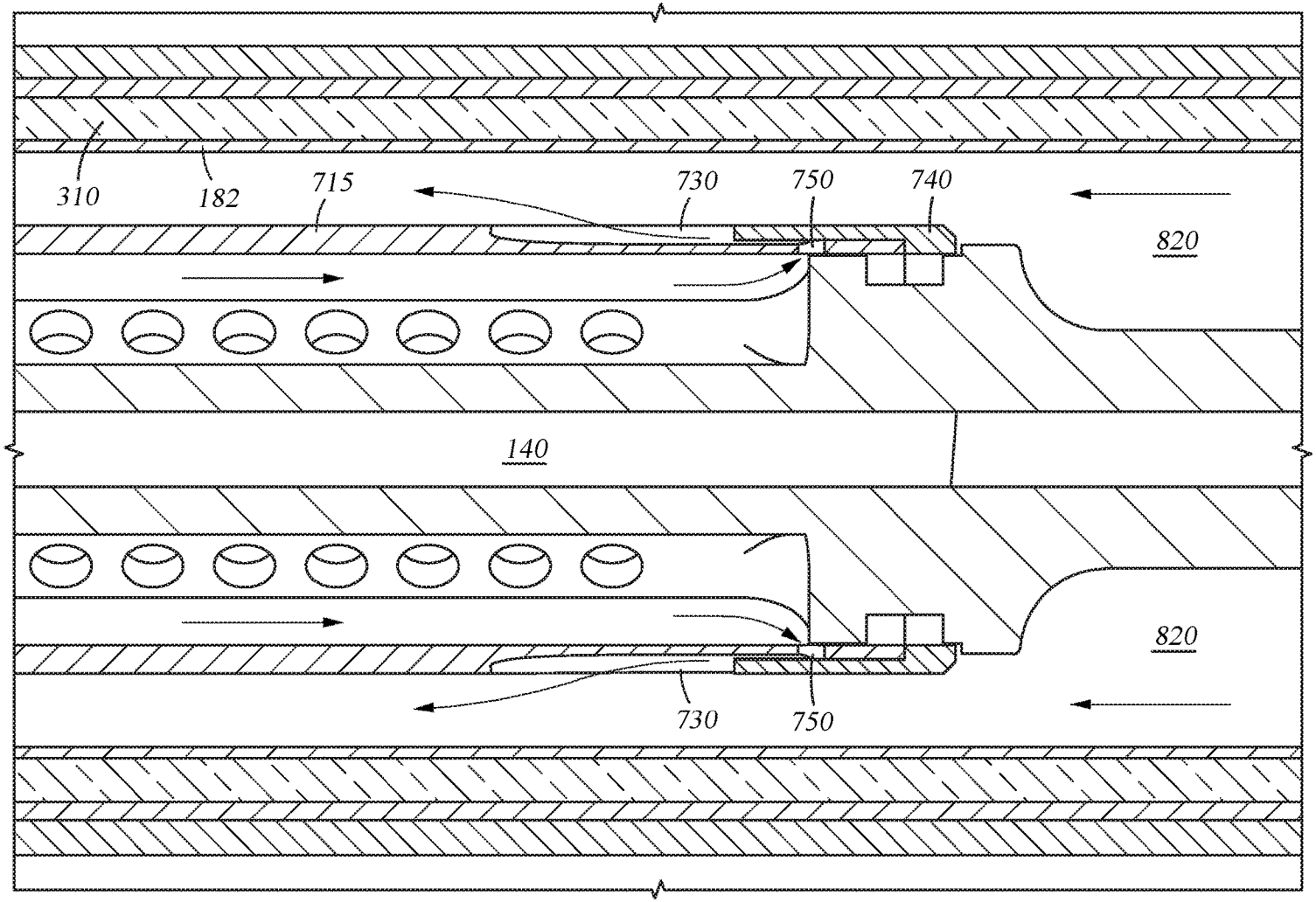
FIG. 14 is an enlarged cross-sectional view showing the flow of fluids (e.g., gases) though the longitudinal recesses and gas ports.

FIGS. 13A and 13B are cross-sectional views of the upper receiver assembly 700 shown in FIG. 7. FIG. 14 is an enlarged cross-sectional view showing the flow of fluids (e.g., gases) though the longitudinal recesses 730 and gas ports 750. Air flow during operation will be explained in greater detail in the remaining Figures.

Every time a projectile 300 is fired from the upper receiver assembly 700, a region of high pressure is formed at the muzzle end 135. At the breach end 210 of the upper receiver assembly 700, a lower pressure region exists, and air is pulled through the interior volume 820 via air gaps 815 at the breach end 210. The air is moved along the direction of arrows in the interior volume 820 toward the muzzle end 135.

Additionally, a portion of hot gases from firing the projectile 300 may escape via one or more openings 1300 provided between the suppressor body 710 and the barrel 705. The hot gases travel in the direction of the arrows from the openings 1300 toward the breach end 210 along a portion of the length of the barrel body 500. Gases then exit the volume between the barrel 705 and the first sleeve 715 via the gas ports 750 formed in the first sleeve 715. The gases travel in the longitudinal recesses 730 (shown in detail in FIG. 14) between the end cap 740 and the first sleeve 715 where the gases mix with air in the interior volume 820. The hot gases, along with the air from the breach end 210, are moved along the direction of arrows in the interior volume 820 toward the muzzle end 135.

The movement of air serves to remove or dissipate heat from surfaces in fluid communication with the air in the interior volume 820 (e.g., between the first sleeve 715 and the second sleeve 182). Thus, heat is removed each time the upper receiver assembly 700 is fired. In one aspect, the upper receiver assembly 100 uses a dual Venturi effect or vacuum to move the hot gases toward the breach end 210 as well as move air from the breach end 210 toward the muzzle end 135. The interior volume 820 also provides an insulating effect when the upper receiver assembly 700 is not being fired as the air separates the first sleeve 715 and the second sleeve 182.

The upper receiver assemblies 100 and 700 as disclosed herein mitigate heat at a greater rate than conventional barrels, specifically suppressed barrels. The upper receiver assemblies 100 and 700 also suppress sound and light, and includes many benefits such as being light weight (about 7 pounds to about 6 pounds, or less), having superior accuracy (about 1.0 MOA or less at 300 yards), and the ability to operate in extreme environments.

While the foregoing is directed to embodiments of the present disclosure, other and further embodiments of the disclosure may be devised without departing from the basic scope thereof, and the scope thereof is determined by the claims that follow.

The invention claimed is:

1. An upper receiver assembly, comprising:

a barrel having a muzzle end;

a suppressor body operable to couple to the muzzle end;

a first sleeve disposable about the barrel and the suppressor body, wherein the barrel includes one or more longitudinally oriented ribs extending radially from a barrel body having a bore formed therein;

a second sleeve surrounding the first sleeve, the second sleeve comprising a fibrous ceramic material, wherein a radial gap is formed between the first sleeve and the second sleeve allowing ambient air to flow therebetween; and a handguard disposed about the second sleeve, wherein the second sleeve is in sealing engagement with an inner diameter of the handguard.

2. The assembly of claim 1, wherein the suppressor body has an outer surface with a channel formed therein.

3. The assembly of claim 2, wherein the channel is a longitudinally oriented groove.

4. The assembly of claim 1, wherein the first sleeve includes a gas port formed in a breach end thereof.

5. The assembly of claim 4, wherein the breach end of the first sleeve includes a longitudinal recess.

6. The assembly of claim 5, wherein the longitudinal recess aligns with the gas port.

7. The assembly of claim 1, wherein the first sleeve includes an end cap.

8. The assembly of claim 1, wherein the handguard includes one or more longitudinally oriented rails.

9. The assembly of claim 8, wherein each of the rails include a through hole formed along a longitudinal direction thereof.

10. An upper receiver assembly, comprising:

a barrel;

a suppressor, the barrel and the suppressor comprising a unitary body surrounded by a first sleeve and coupled to a barrel nut, the barrel nut having a plurality of radially oriented fins;

a second sleeve disposed about the first sleeve and separated from the first sleeve by a radial gap along a longitudinal length of the unitary body, the radial gap allowing ambient air to flow between the first sleeve, the second sleeve and between the radially oriented fins of the barrel nut; and a handguard disposed about the second sleeve and the barrel nut, wherein the second sleeve is in sealing engagement with an inner diameter of the handguard.

11. The assembly of claim 10, wherein the second sleeve comprises a thermally insulative material.

12. The assembly of claim 11, wherein the thermally insulative material comprises a hydrophobic material.

13. The assembly of claim 10, wherein the handguard comprises one or more longitudinally oriented rails, each of the rails having a through hole formed along a length thereof.

14. The assembly of claim 10, wherein the suppressor includes a body having an outer surface with a channel formed therein.

15. The assembly of claim 14, wherein the channel is a longitudinally oriented groove.

16. An upper receiver assembly, comprising:

a barrel having a barrel body with a bore formed therein and a longitudinally oriented rib extending radially from the barrel body, wherein the rib includes a plurality of through holes formed in a direction that is orthogonal to a longitudinal direction of the rib;

a suppressor body operably coupled to a muzzle end of the barrel;

a first sleeve disposed about the barrel and the suppressor body, wherein a volume is formed between an outer surface of the barrel body and an interior surface of the first sleeve;

a second sleeve disposed about the first sleeve and separated from the first sleeve by a radial gap formed between the first sleeve and the second sleeve and extending along a longitudinal length of the barrel body and the suppressor body, the radial gap allowing ambient air to flow between the first sleeve and the second sleeve; and a handguard disposed about the second sleeve, wherein the second sleeve is in sealing engagement with an inner diameter of the handguard.

17. The assembly of claim 16, wherein a gas tube is disposed in the radial gap.

18. The assembly of claim 16, wherein second sleeve comprises a thermally insulative material.

19. The assembly of claim 18, wherein the thermally insulative material comprises a hydrophobic material.

20. The assembly of claim 16, wherein the handguard comprises a longitudinally oriented rail having a through hole formed along a length thereof.

* * * * *